US009427045B1

(12) United States Patent
Hannon

(10) Patent No.: US 9,427,045 B1
(45) Date of Patent: Aug. 30, 2016

(54) SHOELACE TIE ASSEMBLY

(71) Applicant: Gerald Hannon, Brady, NE (US)

(72) Inventor: Gerald Hannon, Brady, NE (US)

( * ) Notice: Subject to any disclaimer, the term of this patent is extended or adjusted under 35 U.S.C. 154(b) by 76 days.

(21) Appl. No.: 13/969,711

(22) Filed: Aug. 19, 2013

Related U.S. Application Data

(60) Provisional application No. 61/684,957, filed on Aug. 20, 2012.

(51) Int. Cl.
*A43C 7/00* (2006.01)
*A43C 1/06* (2006.01)

(52) U.S. Cl.
CPC . *A43C 1/06* (2013.01); *A43C 7/00* (2013.01); *Y10T 24/3703* (2015.01); *Y10T 24/3718* (2015.01); *Y10T 24/3724* (2015.01); *Y10T 24/398* (2015.01); *Y10T 24/3916* (2015.01)

(58) Field of Classification Search
CPC . Y10T 24/15; Y10T 24/155; Y10T 24/3918; Y10T 24/3724; Y10T 24/3703; Y10T 24/3916; Y10T 24/3927; Y10T 24/398; Y10T 24/39; A43C 7/00
USPC ..... 24/30.5 R, 30.5 S, 30.5 W, 712.2
See application file for complete search history.

(56) References Cited

U.S. PATENT DOCUMENTS

| | | | | |
|---|---|---|---|---|
| 841,419 | A * | 1/1907 | Molkenbur | 24/712.4 |
| 5,572,778 | A * | 11/1996 | Stenner et al. | 24/712.9 |
| 5,924,177 | A * | 7/1999 | Jongejan | 24/712.2 |
| 2005/0210639 | A1* | 9/2005 | Cuisinier | 24/455 |
| 2011/0113606 | A1* | 5/2011 | Sloan | 24/713.4 |
| 2014/0020263 | A1* | 1/2014 | Theuvenet | A43B 3/0005 36/50.1 |
| 2014/0115842 | A1* | 5/2014 | Sloan | 24/712.2 |
| 2015/0223569 | A1* | 8/2015 | Cox | A43C 7/00 24/712.4 |

* cited by examiner

*Primary Examiner* — Robert J Sandy
*Assistant Examiner* — Michael Lee
(74) *Attorney, Agent, or Firm* — Advent, LLP

(57) ABSTRACT

Apparatus and techniques for securing a shoelace are described. In accordance with embodiments, the shoelace is secured without forming a knot with the ends of the shoelace. In described examples, a shoe tie assembly includes a housing with at least two apertures configured to individually receive one of the ends of the shoelace that is inserted in a first direction along a lengthwise axis of the shoelace. A securing device is included in the assembly to secure the shoelace and housing to substantially permit movement of the shoelace in the first direction generally and to substantially prevent movement of the shoelace in a second direction that is generally opposite the first direction in the first configuration. The securing device is also operable to obtain a second configuration in which the securing device permits the shoelace to move in the second direction.

7 Claims, 6 Drawing Sheets

SHOELACE TIE ASSEMBLY

CROSS-REFERENCE

This application claims priority to U.S. Provisional Application Ser. No. 61/684,957 under 35 U.S.C. 119(e), entitled: SHOELACE TIE ASSEMBLY, filed on Aug. 8, 2012, which is herein incorporated by reference in its entirety.

BACKGROUND

Shoelaces (shoe-strings, shoelaces, boot laces) are commonly used to secure shoes, boots, and other footwear on a user's foot. A shoelace generally comprises a string or cord (one for each shoe), finished off with an aglet, or stiff section. The shoelace passes through a series of holes or eyelets disposed on flaps included on either side of a shoe that bridge an opening into which a person's foot is inserted. The flaps are generally disposed opposite the shoe's sole or tread. The shoelace is woven in an overlapping manner between the holes or eyelets on the flaps. As a result, a user can tension the shoelace to draw the flaps together and secure the shoe on a foot. Shoelaces are secured by forming a knot between the ends of the cord so the shoelace remains tensioned. This process of tensioning and forming a knot is often referred to as tying one's shoes. A user can loosen the shoe by untying the knot and allowing the lace to become slack so the flaps can move away from the opposing flap. This permits a user to remove the shoe.

SUMMARY

Apparatus and techniques for securing a shoelace are described. In accordance with embodiments, the shoelace is secured without forming a knot with the ends of the shoelace. In described examples, a shoe tie assembly includes a housing with at least two apertures configured to individually receive one of the ends of the shoelace that is inserted in a first direction along a lengthwise axis of the shoelace. A securing device is included in the assembly to secure the shoelace and housing to substantially permit movement of the shoelace in the first direction generally and to substantially prevent movement of the shoelace in a second direction that is generally opposite the first direction in the first configuration. The securing device is also operable to obtain a second configuration in which the securing device permits the shoelace to move in the second direction.

This Summary is provided solely to introduce subject matter that is fully described in the Detailed Description and Drawings. Accordingly, the Summary should not be considered to describe essential features nor be used to determine scope of the claims.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

Tying shoes is a problem for some people. Tying shoelaces can require a significant amount of manual dexterity to tie a knot. Some young children and people with arthritis and similar medical conditions experience significant difficulty tying knots. Further, some people are unable to reach their shoelaces in order to tie or untie them. For example, some people are insufficiently flexible to bend to tie his or her shoelace. Other people may only have use of a single functioning hand, e.g. an amputee or a person suffering from paralyses. This can be a source of great concern, may cause the person embarrassment, have them rely on another person to tie his or her shoelaces, or only wear loose-fitting slip-on type footwear. Slip-on type footwear may pose a tripping hazard for people who also suffer from limited mobility. The prevalence of footwear with shoelaces also significantly limits the footwear selection for those who are unable to tie their own shoes.

Accordingly, shoelace tie assemblies are described that permit securing of a shoelace so footwear can be secured to a person's foot without forming a knot in the shoelace. Shoelace tie assemblies in accordance with the present disclosure can be operated with a single hand. In embodiments, a shoelace tie assembly includes a housing configured with a securing device that is configured to hold an end portion of the shoelace securely under tensions, such as when the shoelace is drawing opposing flaps of a shoe together. The securing device, in embodiments, is configured to substantially permit the end portion to move in a first direction while preventing it from moving in the opposite direction. For example, the securing device in a first configuration is constructed so a user can tension the shoelace along its length while the securing device prevents it from moving in the opposite direction that would cause the shoelace to loosen. The securing device can be operated to obtain a second configuration in which the securing device permits the end portion to move in a second direction that is opposite the first direction. For example, an external force is exerted on the securing device to cause it to release the end portion so the shoelace can loosen and a user can slip his/her foot out of the shoe.

Techniques are also described for securing a shoelace without forming a knot between the shoelace's ends. In embodiments, the technique includes tensioning a shoelace in a first direction where a tab is biased to permit movement in a first direction while preventing movement of the shoelace in a second direction that is opposite the first direction. An external force can be exerted on the tab to cause the tab to obtain a second configuration so the tab permits the shoelace to move in the second direction, so for example, the shoelace can be loosened.

Example Shoe Tie Assembly

Figure 1:
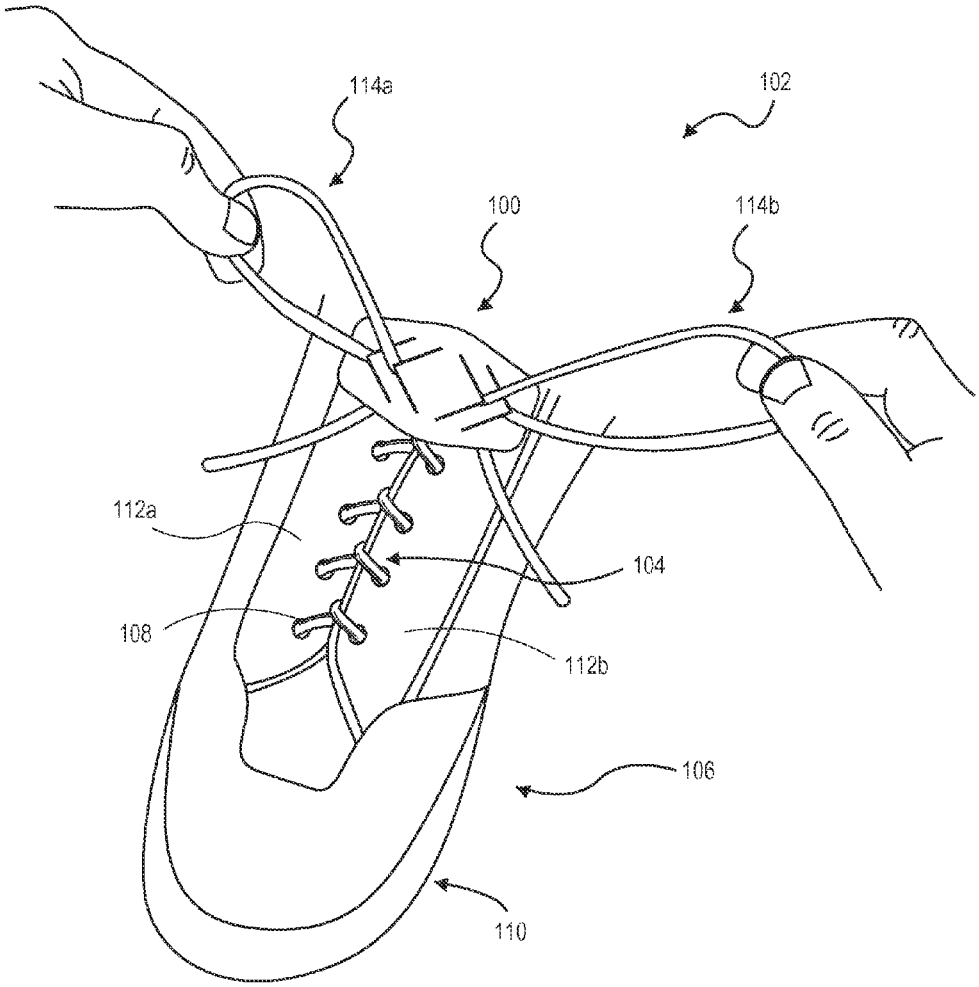
FIG. 1 is a perspective view illustrating a shoelace tie assembly, where an operator is pulling on shoelace loops to tighten shoelaces in accordance with example implementations of the present disclosure.
Figure 2:
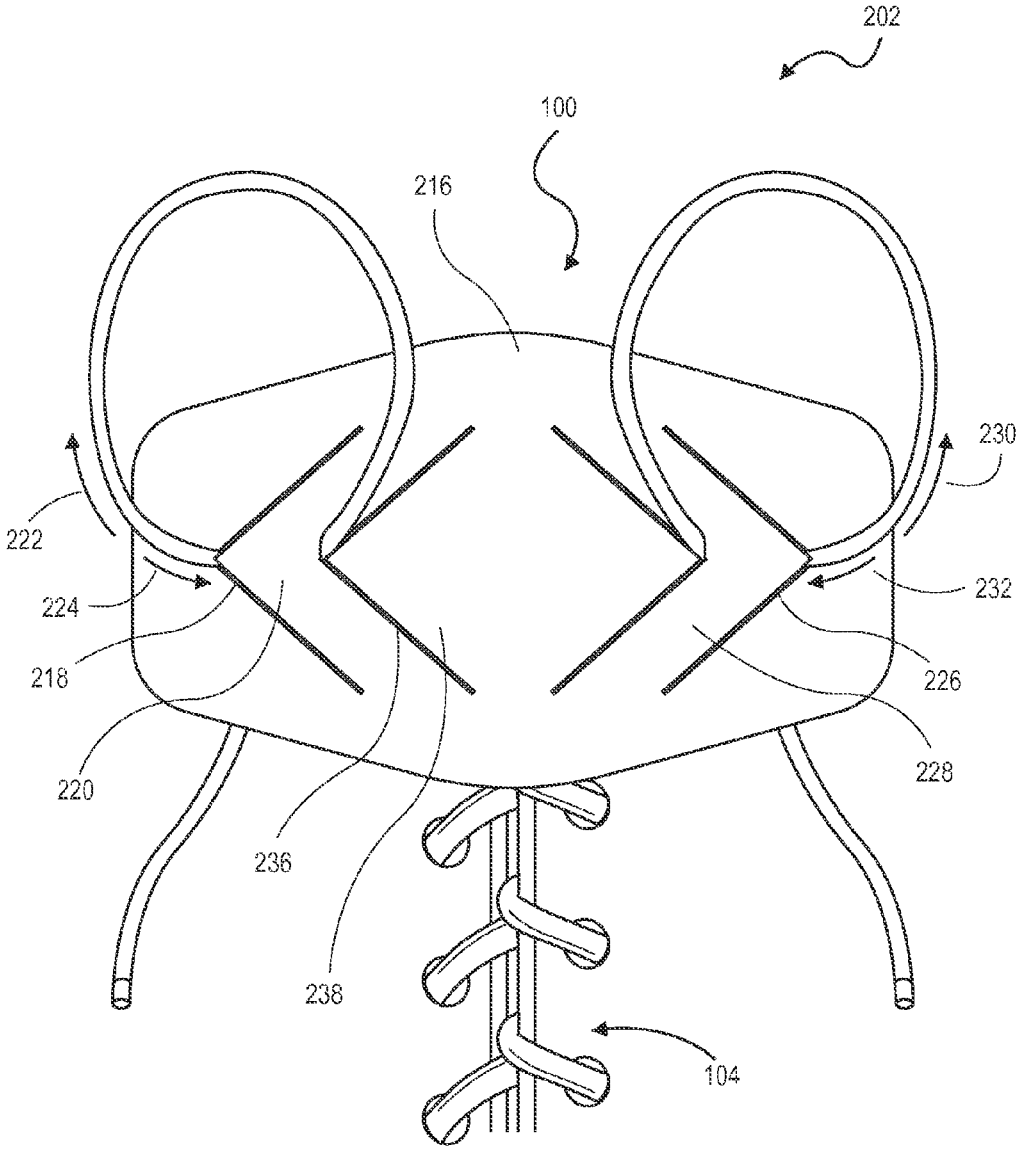
FIG. 2 is an enlarged view of the shoelace tie assembly of FIG. 1.

With reference to FIGS. 1 and 2 that illustrate an example shoe tie assembly 100. For the purpose of explanation, the shoe tie assembly is shown in a sample environment 102 that represents the shoe tie assembly 100 securing a shoelace 104. The shoe tie assembly 100 is connected to a shoelace 104 included on a shoe 106. It is to be appreciated, that the shoe tie assembly 100 can be used with boots and other footwear that include shoelaces in order to secure the shoelace without forming a knot.

The shoelace 104, as shown, passes between eyelets 108 (one is referenced) included on opposing flaps formed in the shoe 106 generally opposite a sole 110 or tread of the shoe. The shoelace 104 passes between the eyelets so it weaves between the eyelets on the opposing flaps. In this arrangement, the lace 104 can be tensioned to draw the flaps (112*a*, 112*b*) together to at least partially secure the flaps around the wearer's foot to secure the shoe to the foot. Although eyelets are shown, other structures may be used for substantially the same purpose. Example structures include, but are not limited to, holes, eyelets, loops, and/or hooks in a piece of footwear. Typically, shoelaces 104 are sized so a portion of the lace extends beyond the last eyelet through which the shoelace is passed to allow the shoelace to be tied in a knot. For example, previously, a first end portion 114*a* of the shoelace would be tied in a bow-knot with a second end portion 114*b* of the shoelace 104 that extends from the opposite flap.

Referring to FIG. 2, an enlarged view of the shoe tie assembly 100 of FIG. 1 is illustrated in conjunction with an environment 202. The shoe tie assembly 100 includes a housing 216 that defines one or more apertures through which the shoelace 104 can pass. As shown, the housing 216 defines a first slot 218 generally aligned with an aperture of the shoe through which the lace passes to attach the assembly 100. This is to say that the shoelace passes from the shoe, e.g., one of the eyelets, to the first slot. In the illustrated embodiment, a portion of the housing 216 adjacent the slot forms a tab 220. The tab 220 can be used as a means for securing the shoelace 104 when the tab 220 is in a first configuration. For example, the tab 220 is biased so it pinches the first end portion 114*a* against a portion of the housing 116 opposite the tab 220 in the first configuration. Thus, the tab 220 can substantially permit movement of the first end portion of the shoelace in a first direction 222 (e.g., a direction that tensions the lace) and substantially prevent movement of the end portion of the shoelace in a second direction 224 that is generally opposite the first direction 222 (e.g., in a direction that loosens the lace) in the first configuration. The tab 220 can be biased into the first configuration were no force is applied to the tab. In embodiments the tab 220 is a plastic tab that deflects out of the first configuration were an external force is applied.

The tab 220, in the first configuration, can permit a user to pull the first end portion of the shoelace to tension it so when the user releases the lace, the tab 220 catches the lace and prevents it from moving substantially in the second direction 224. For example, a user can pull on an end of the shoelace at an acute angle with respect to a plane encompassing the housing to place additional tension on the lace with the tab in the first configuration. The first and second directions, in embodiments, correspond to the axial or lengthwise direction of the shoelace 104.

It is to be appreciated that additional apertures, e.g., slots can be included in the housing. The housing can define a second slot 226 adjacent to the first slot 218 so that the first slot 218 and the second slot 226 are generally aligned with opposing apertures on the shoe (e.g. opposing eyelets). The second tab 228 is configured and/or operates in substantially a similar manner to that described with respect to the first tab 220. Thus, the second tab 228 can be configured to substantially permit a second end portion of the shoelace to move in a third direction 230 (e.g., a tension direction) and substantially prevent the second end portion from moving in a fourth direction 232 (e.g., in a direction that loosens the lace) in a first configuration. The third and fourth directions can correspond to the axial or lengthwise direction of the shoelace 104 and it is to be apparent that the directions may coincide with another direction, e.g. the second and third directions may coincide such as if the shoelace 104 is laid in a straight line.

Figure 3:
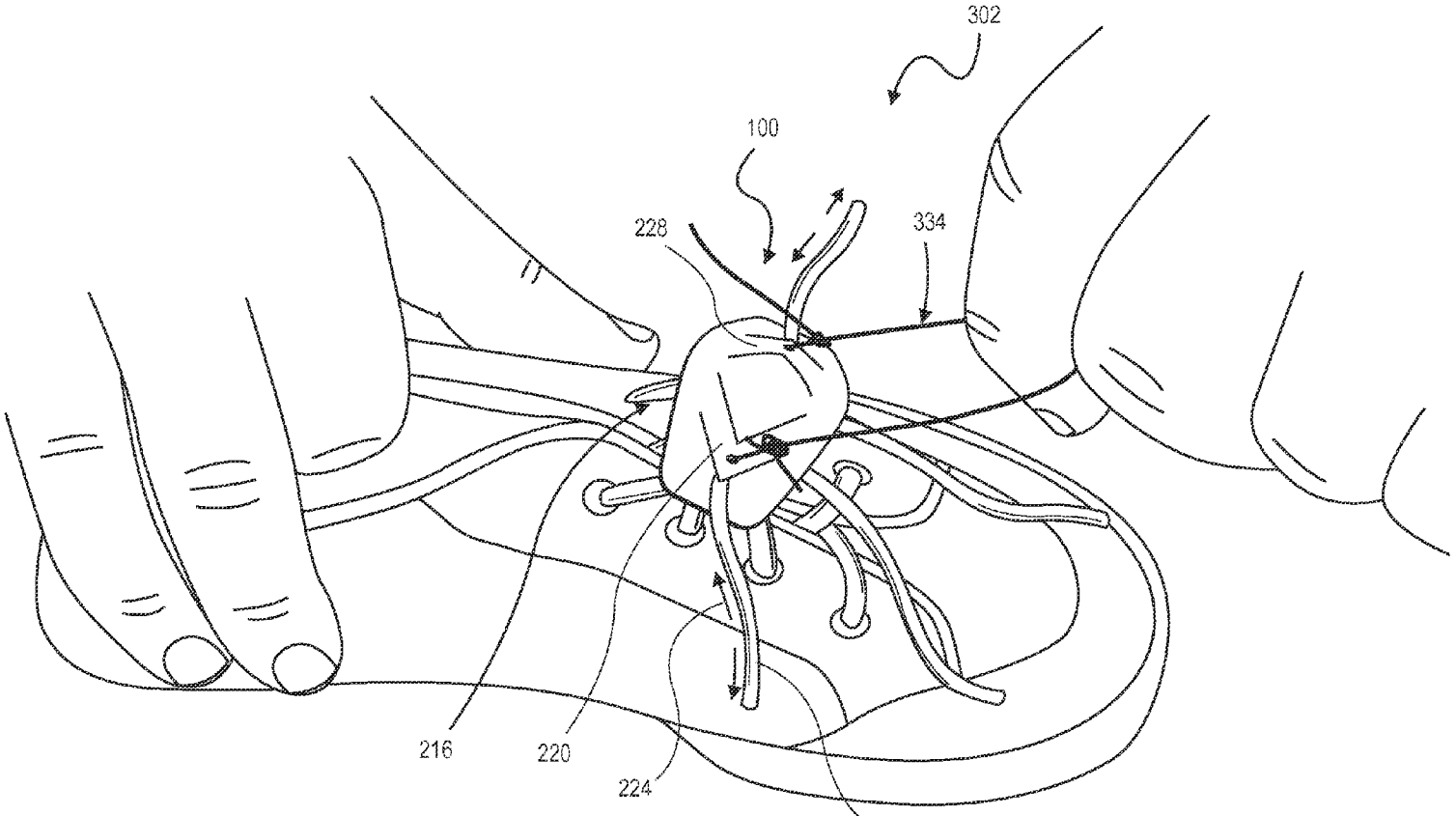
FIG. 3 is a perspective view illustrating a shoelace tie assembly, where a user is pulling on a release cord to release the shoelaces in accordance with example implementations of the present disclosure.

FIG. 3 illustrates the shoe tie assembly 100 and shoe 106 in a sample environment 302. As illustrated, a tab, such as the first or second tabs 220, 228, has a second configuration. The second configuration corresponds with an external force being exerted on the tabs, e.g., generally perpendicular to the first or second direction. For example, the first tab 220 may be pulled so it releases the first end portion 114*a* of the shoelace so the lace can move substantially freely in the second direction 224 (e.g., loosen). The first tab, for example, may deflect out of a plane that substantially encompasses the housing so a user can release the tension on the shoelace to remove his or her foot from the shoe 106. Although movement of the shoelace is described, it is to be apparent that the shoe tie assembly may move so that the end of the lace has effectively moved with respect to the shoe tie assembly. A user may grasp a string 334 or similar means for grasping connected to the first and second tabs 220, 228 to deflect them away from the housing 216 to release the end portions and loosen the shoelace. Having described how the shoe tie assembly can be implemented to secure and/or loosen a shoelace, how a shoelace may be looped is now described.

Referring again to FIG. 2, as shown, the housing 216 defines additional apertures, e.g., slots. For example, the housing defines additional slots (two are illustrated) with corresponding tabs that can be configured and/or operate similar to the first and second tabs. A third slot 236 and third tab 238, for example, are formed between the first and second slots. The third slot 236 and tab 238 can be used in conjunction with the first slot 218 and tab 220 to form the first end portion 114*a* of the shoelace into a loop. For example, the first and third slots are constructed so a user can loop the first end portion between the slots so the first end portion does not pose a tripping hazard or extend beyond the sole where it may be stepped on. Having described securing, loosening and looping a shoelace, additional shoe tie assembly embodiments are now described.

Figure 4:
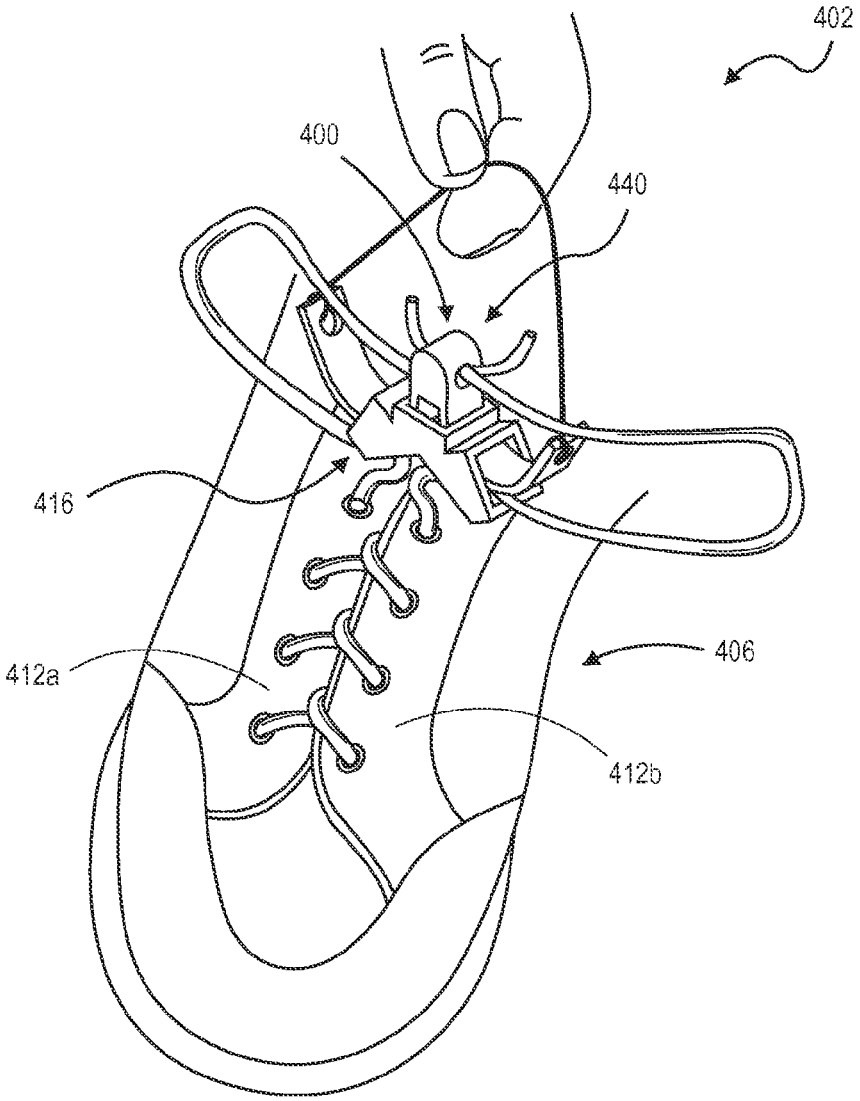
FIG. 4 is a perspective view illustrating a shoelace tie assembly including a tensioner, where an operator is pulling on shoelace loops to tighten shoelaces in accordance with example implementations of the present disclosure.
Figure 5:
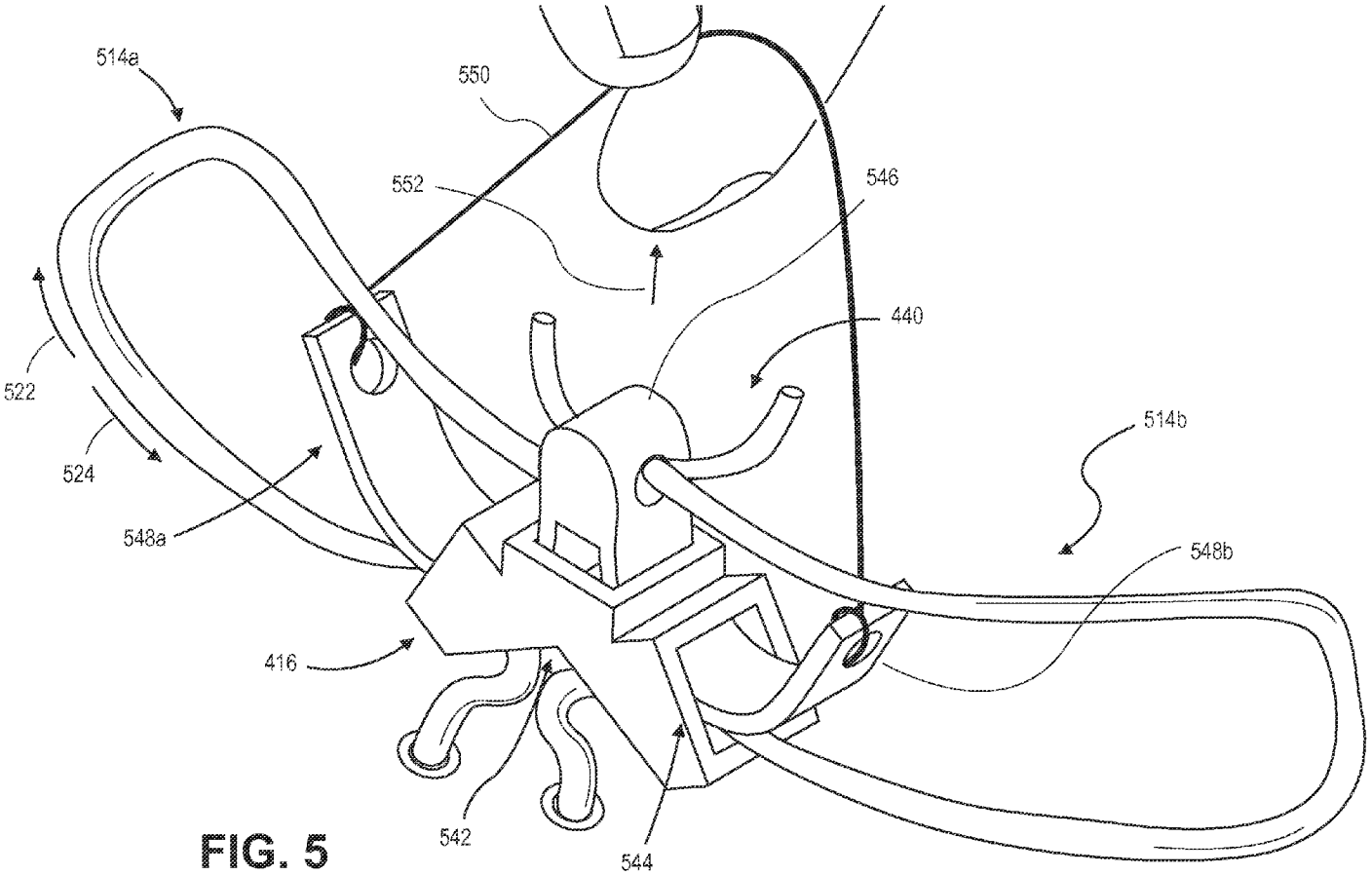
FIG. 5 is an enlarged view of the shoelace tie assembly of FIG. 4.

Referring now to FIGS. 4 and 5, a shoe tie assembly 400 in accordance with an embodiment of the present disclosure is illustrated in an environment 402 including a shoe 406. As shown, the assembly 400 includes a housing 416 that is configured to contain a tensioner 440. The shoe tie assembly 400 of the present embodiment can be used with a variety of footwear and styles of shoelaces much like those described in conjunction with FIGS. 1-3 above. The assembly 400 as illustrated is coupled to a shoelace 406 woven between eyelets included on flaps 412*a*, 412*b*, that generally oppose one another, on the shoe 406.

As may be seen in FIG. 5, the housing 416 includes one or more apertures for accepting the shoelace's ends. For example, the housing 416 includes an aperture 542 through which a first end portion 514*a* of the shoelace and the second end portion 514*b* of the shoelace pass. The shoelace end portions can extend through the housing 416*b* and out another aperture 544.

The tensioner 440 is positioned in the housing 416 so it is operable to engage one or more of the end portions 514*a*, 514*b* to tension and/or secure one or more of the end portions. The tensioner 440, as shown, is formed with a central portion 546 that connects two curved wings 548*a*, 548*b* that arch in a direction opposite the central portion 546, e.g., to form a "W" shaped profile. The tensioner 440 can be formed so it is biased against one or more interior wall of the housing, e.g., interior surfaces generally opposite the central portion 546. For example, the curved wings of the tensioner may exert a spring force against an interior wall of the housing to capture, respectively, the end portions that pass between the surface of the wall and the curved wing. Although the tensioner 440 has been particularly described, it is to be appreciated that a variety of tensioners with various biasing systems can be employed. It is the intention of this disclosure to encompass such variation.

In embodiments, one or more of the wall, this is to say the interior surface, or a portion of the curved wings facing the wall's surface include teeth or are textured to assist in securing the shoelace in place. For example, a portion of the curved wings 548*a*, 548*b* includes a series of teeth spaced apart along the length of the curved wing. Thus, the tensioner 440, where not influenced by an external force, can act as a means for securing the shoelace in place relative to the assembly.

The assembly 400 and/or tensioner 440 in accordance with embodiments of the present disclosure can be configured so an end portion of the shoelace is substantially permitted to move in a first direction 522 while being substantially prevented from moving in a second direction 524 opposite the first direction. For example, the assembly 400 is configured so the first end portion 514*a* can move in a first direction 522 (e.g., a direction that permits the shoelace to tighten the flaps 412*a*, 412*b*) and prevents movement in a second direction 524 (e.g., a loosening direction) when in a first configuration. In this manner, a user can pull on the first end portion in the first direction 522 to tension the shoelace so the flaps are drawn closer together. The first configuration may be associated with the tensioner being un-actuated, e.g., no external force applied.

With continued reference to FIG. 5, the tensioner 440 may be configured to obtain a second configuration. An external force is applied to the tensioner 412*a*, 412*b* to cause it to release the shoelace. For example, a means for grasping, such as a string 550 (connected, respectively, adjacent a distal end of the curved wings 548*a*, 548*b*), pulled in direction 552, or generally away from the housing (e.g., generally perpendicular), can cause the curved wings to release one or more of the first end portion 514*a* or the second end portion 514*b* so they can substantially move freely in the second direction 522 (in the case of the first end portion).

Additionally, it is to be appreciated that an aperture can be formed without a tab. For example, a circular aperture can be formed to receive the end of the shoelace after it has passed (spatially) through a slot included a tab.

The structures described herein, e.g., the housing, tabs and tensioner can be formed of a variety of materials or combination of material based on design preference, aesthetics, and so forth. While it is contemplated that one or more of these structures may be formed of plastic, other materials can be used as well. For example, a housing may be formed of metal while a tab or tensioner is formed of plastic. Example plastics that are suitable for use include polycarbonates, nylon, nylon 6, 6, and the like plastics, or combination of plastics. As is to be appreciated, different components may be formed of different materials. The tensioner 440 may be formed of nylon, while the housing may be formed of a polycarbonate.

It is to be apparent that the structures, techniques and approaches described with respect to FIGS. 1-5 may be implemented in conjunction with the methods described below.

Example Methods

The following discussion describes methods that may be implemented in conjunction with embodiments of the shoe tie assembly described above. The methods are shown as a set of blocks that specify operations and are not necessarily limited to the order shown. In portions of the following discussion, reference may be made to the shoe tie assemblies and/or its components. The techniques described below are independent of the structures described above, meaning that the techniques may be implemented in a variety of ways and are not necessarily limited to the structures illustrated in FIGS. 1-5.

Figure 6:
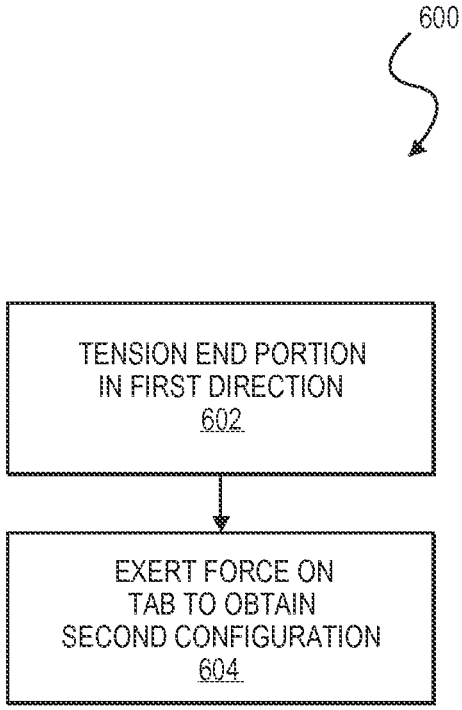
FIG. 6 is a flow diagram illustrating a method in accordance with example implementations of the present disclosure.

FIG. 6 depicts a method 600 in an example implementation for securing and/or releasing a shoelace associated with footwear, such as a shoe. In embodiments, the method and/or steps of the method can be performed in a single-handed manner, although two hands may be used as well.

As illustrated, a first end portion of a shoelace is tensioned in a first direction where a shoe tie assembly is in a first configuration (Block 602). For example, a shoelace may be tensioned so it draws two or more flaps included on a piece of footwear together in order to tighten the footwear on a user's foot. In embodiments in accordance with the present method, the first end portion is substantially prevented from moving in a second direction (e.g., a loosening direction) that is generally opposite the first direction. In the previous example, a tab or a wing included in a shoe tie assembly may function to catch the first end portion to prevent it from coming loose once the strain is released from a free end of the shoelace. Further, the tension placed on the first end portion may be sufficient to overcome a spring bias on the tab or wing.

In embodiments, an external force is exerted on a tab so the shoe tie assembly changes to a second configuration (Block 604). The second configuration can be associated with the shoe tie assembly being configured to substantially permit an associated shoelace to move substantially freely in a second direction, e.g., a loosening direction. For example, a force is applied to a wing included in a tensioner to cause it to release a shoelace to permit two more flaps included on a boot to move apart from one another so a user can remove his/her foot from an opening formed in the boot adjacent the flaps.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A shoelace tie assembly comprising:

a housing that defines a first slot generally aligned with an aperture of a shoe with a first tab that comprises a portion of the housing that bounds the first slot, the first tab being biased to pinch a first end portion of a shoelace between the first tab and a portion of the housing opposite the first tab to at least substantially permit movement of the first end portion in a first direction and prevent movement of the shoelace in a second direction in a first configuration where an external force is not exerted on the first tab and to at least substantially permit movement of the shoelace in the second direction generally opposite the first direction in a second configuration where an external force is exerted on the first tab;

a second slot generally aligned with an opposing aperture of the shoe with a second tab that comprises a portion of the housing that bounds the second slot, the second tab being biased to pinch a second end portion of a shoelace between the second tab and a portion of the housing opposite the second tab to at least substantially permit movement of the second end portion in a third direction and prevent movement of the shoelace in a fourth direction in a first configuration where an external force is not exerted on second first tab and to at least substantially permit movement of the shoelace in the fourth direction generally opposite the third direction in a second configuration where an external force is exerted on the second tab; and a third slot with a third tab that comprises a portion of the housing that bounds the third slot, the third tab being biased to pinch the first end portion of a shoelace between the third tab and a portion of the housing opposite the third tab, the third slot being positioned between the first and second slots, the first and third slots being configured to permit the first end portion to pass through the first and third slots to form a loop with the first end portion.

2. The shoelace tie assembly as recited in claim 1, wherein the housing further defines a first aperture that is arranged so the first end portion of the shoelace extends through the first slot and the first aperture to form a loop, and the housing further defines a second aperture that is arranged so the second end portion of the shoelace extends through a the second slot and the second aperture to form a loop there between.

3. The shoelace tie assembly as recited in claim 1, further comprising means for grasping at least one of the first or second tabs to cause the one of first and second tabs to obtain the second configuration where the external force is exerted on the grasping means.

4. The shoelace tie assembly as recited in claim 3, wherein the grasping means comprises a string coupled between the first and second tabs, the string being configured to cause the first and second tabs to obtain the second configuration where the external force is exerted on the string.

5. The shoelace tie assembly as recited in claim 1, wherein the housing is formed of a plastic material.

6. The shoelace tie assembly as recited in claim 5, wherein the plastic material is selected from the group comprising: nylon; polycarbonate; and nylon 6,6.

7. The shoelace tie assembly as recited in claim 1 wherein, when un-actuated, at least one of the first tab, the second tab, or the third tab is positioned substantially in a plane that encompasses the housing.

* * * * *